US007235057B2

(12) United States Patent
LeVert et al.

(10) Patent No.: US 7,235,057 B2
(45) **Date of Patent: *Jun. 26, 2007**

(54) ADJUSTABLE FOOT ELEVATOR

(76) Inventors: Faye B. LeVert, 1909 Matthew La., Knoxville, TN (US) 37923; Francis Edward LeVert, 1909 Matthew La., Knoxville, TN (US) 37923

( * ) Notice: Subject to any disclaimer, the term of this patent is extended or adjusted under 35 U.S.C. 154(b) by 370 days.

This patent is subject to a terminal disclaimer.

(21) Appl. No.: 10/843,155

(22) Filed: May 12, 2004

(65) Prior Publication Data

US 2004/0230141 A1 Nov. 18, 2004

Related U.S. Application Data

(60) Provisional application No. 60/469,128, filed on May 12, 2003.

(51) Int. Cl.
*A61H 23/02* (2006.01)
*A47C 20/02* (2006.01)

(52) U.S. Cl. ..... 601/49; 601/58; 5/648; 5/915

(58) Field of Classification Search ..... 601/49, 601/56, 57, 58, 148; 5/648, 644, 655.3, 706, 5/710, 711, 713, 915; 128/845
See application file for complete search history.

(56) References Cited

U.S. PATENT DOCUMENTS 3,333,286 A * 8/1967 Biolik ..... 5/632
6,206,475 B1 * 3/2001 Tai ..... 297/452.41
6,442,779 B1 * 9/2002 LeVert et al. ..... 5/648

* cited by examiner

*Primary Examiner*—Quang D. Thanh

(57) ABSTRACT

Foot elevator comprising a compound prismatoid capable of controlled vertical and horizontal expansion is described. The foot elevator comprising an inflatable material that describes a compound prismatoid when deployed, an air pump for inflating the foot elevator, an electric operated vibrator that can provide movement of the surface of the foot elevator during use. The foot elevator is designed to provide relief and relaxing feeling to the lower extremities of the human body.

4 Claims, 4 Drawing Sheets

ADJUSTABLE FOOT ELEVATOR

CROSS-REFERENCE TO RELATED APPLICATIONS

Pursuant to 35 USC Section 119, this application claims the benefit of priority from Provisional Application Ser. No. 60/469,128 with a filing date of May 12, 2003.

STATEMENT REGARDING FEDERALLY SPONSORED RESEARCH OR DEVELOPMENT

Not Applicable

BACKGROUND OF THE INVENTION

1. Field of the Invention

This invention relates generally to situations where it is necessary to elevate the feet to reduce discomfort in the lower legs and feet of a person.

2. Status of Prior Art

There is a specialized field of medical science dealing with the use of mechanical devices that are designed to support feet and legs in the rehabilitation of injured or impaired joints and muscles. Scott, U.S. Pat. No. 5,046,487 discloses a leg elevator for use after surgical procedures. Pecheaux, U.S. Pat. No. 4,323,060 and Andrews, U.S. Pat. No. 4,336,796 disclosed leg and foot elevators for the postoperative period. These devices unlike that of Engleman, U.S. Pat. No. 5,725,486 are intended for specific applications and teach a leg elevator that is useful in all applications where the leg is immobilized. None of these devices are designed for general applications where a user simply desires to elevate the feet to minimize discomfort caused by edema or swelling of the feet and lower legs after hours of being ambulatory.

Jackson, U.S. Design Pat. No. 416,428 disclosed an ornamental design for an inflatable orthopedic pillar with aperture. Though not specifically designed for elevating the foot, Raftery, U.S. Pat. No. 5,432,967 disclosed a multiple position resilient support cushion that could be formed of a foam material or an air inflatable bladder. The apparatus of Raftery was designed to support the head and body of the user when in a lying, sitting and in an in-between resting position. LeVert et al., U.S. Pat. No. 6,442,779 discloses a device for selectively elevating the feet to variable heights depending on the desire of the user. The height of the device is set by a user by controlling the air input to a plastic prismatoid.

It is an object of this invention to provide an improved appliance that can be used to elevate and to vibrate the feet and lower legs so as to serve to reduce the edema and swelling of the lower body extremities (hereafter referred as LBE).

It is a further object of this invention to provide an inflatable prismatoid shaped feet and legs elevator with widthwise undulations.

Yet another object of the invention is to provide a foot elevator with selectable vertical heights and horizontal lengths'

These and other objects will become apparent during the course of the detailed description of the apparatus of this invention.

SUMMARY OF THE INVENTION

An air impervious inflatable foot and leg elevator designed to be applicable to situations where it is necessary to eliminate discomfort in the feet and lower leg regions of the body by elevating the feet above a plane that is coplanar with the axial center of a lying human body or in general elevating the feet. The compound prismatoid is capable of controlled vertical and horizontal expansion The foot elevator comprising an inflatable material that describes a compound prismatoid when deployed, a gas pump for inflating the foot elevator, an electric operated vibrator operating in cooperation with the air pump to provide movement of the surface foot elevator during use, a valve through which the inflating gas is introduced into the inner volume of the elevator and a non slip mechanism to prevent displacement of the foot elevator during use.

DETAILED LIST OF FIGURES

DETAILED DESCRIPTION OF THE INVENTION

FIRST EMBODIMENT

Figure 1:
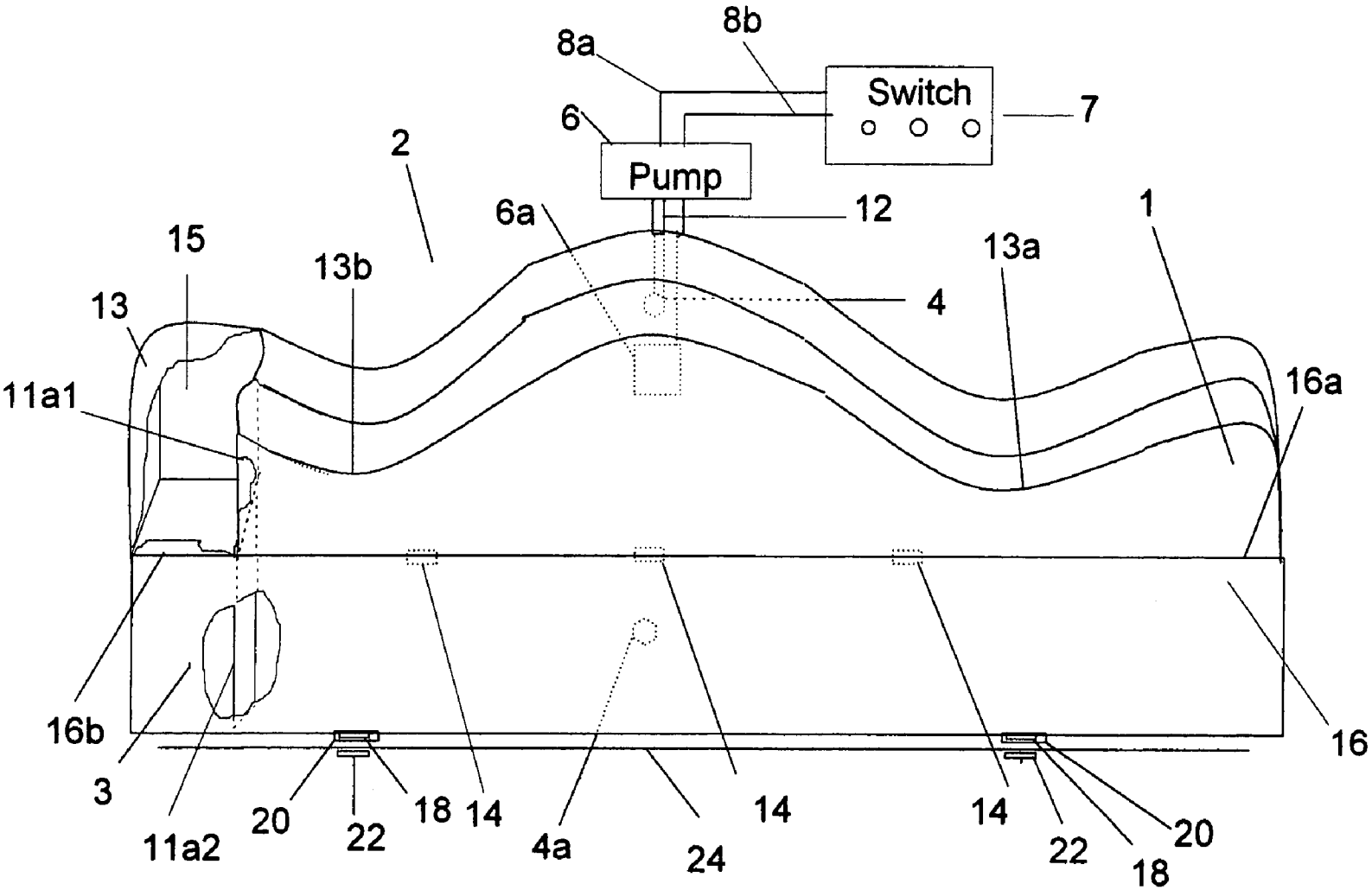
FIG. 1 is a frontal view of the apparatus of the first embodiment of this invention

Referring now to the figures, and more particularly to FIG. 1, a sketch according to one embodiment of the present invention is shown as referenced by the numeral 2. The inflatable prismatoid shaped foot elevator 2 of the first embodiment has multiple chambers designed to support the inflation of the prismatoid shaped foot elevator to at least one or more different operational vertical heights and horizontal lengths during use. The prismatoid shaped foot elevator of FIG. 1 comprises: chambers 1 and 3 the bottom and top of which, respectively, are defined by sheet 16 of FIG. 1 Chamber 1 is the topmost chamber. One way flow of fluid between chambers 1 and 3 is controlled by relief valves 14. These valves permit the operation of the foot elevator at two different vertical heights. The foot elevator of FIG. 1 could be operated at one vertical height with the relief valves 14 replaced by a throughhole in sheet 16. The foot elevator of FIG. 1 will hereafter be referred to as FE 2.

FE 2 when fully or partially inflated is designed to support the feet, legs and knees (These body parts will hereafter be referred to as the lower body extremities (LBE)) in a manner so as to achieve the gradual increase in the elevation of the legs relative to the knees and the feet relative to the legs. Chamber 1 is inflated to slightly less than 0.3 psig when FE2 is partially inflated while chamber 3 remains essentially deflated. At pressures higher than 0.3 psig, which is the cracking pressure of relief valves 14, fluid from chamber 1, by way of relief valves 14, begins to flow into chamber 3. In FIG. 1, the topmost chamber 1, because of the orientation of one or more relief valves relative to the interior of chamber 3 is the first to be inflated while the second chamber 3 is only inflated after chamber 1 is inflated to 0.3 psig. The relief valves could be orientated relative to chamber 1 such that chamber 3 is the first chamber inflated. Alternatively, as mentioned above, the relief valves 14 could be replaced by throughhole(s) in sheet 16 such that both chambers would essentially be inflated almost simultaneously. Also, while multiple relief valves are used in this invention, a single relief valve could have been used. FE 2 is designed to provide topmost surface 13 with one or more undulations (see FIG. 1) in a widthwise direction such that all or portions of the LBE can be held together in a single trough or apart in the separate troughs 13*a* and 13*b* as shown in FIG. 1. Additionally, lengthwise the topmost surface 13 is designed to provide support for the LBE by strategically positioning crest 13*c* and trough 13*d* (see FIG. 2), respectively. Under normal circumstances, in the case of a single recess at the center of the foot elevator (not shown in FIG. 1), the feet tend to slip under the force of gravity toward the center of the FE 2 away from its lateral edges. The recesses 13*a* and *b* in surface 13 are controlled by anti-ballooning variable height vanes 11*a*1 (typical of six) in chamber 1 and 11*a*2 (typical of four) in chamber 3 mounted in the interior of chambers 1 and 3 of FE 2 as given in FIG. 1. In FIG. 1, the number of anti-ballooning variable height vanes is chosen as 5 and 4 for chambers 1 and 3, respectively; however the number may vary, depending on the desired contour or general shape of topmost surface 13. The material of construction of the FE 2 may be plastic, vinyl, rubber or other non-porous materials. Also, the topmost surface 13 may be textured as by flocking with rayon or other polymeric or non-polymeric materials.

Figure 2:
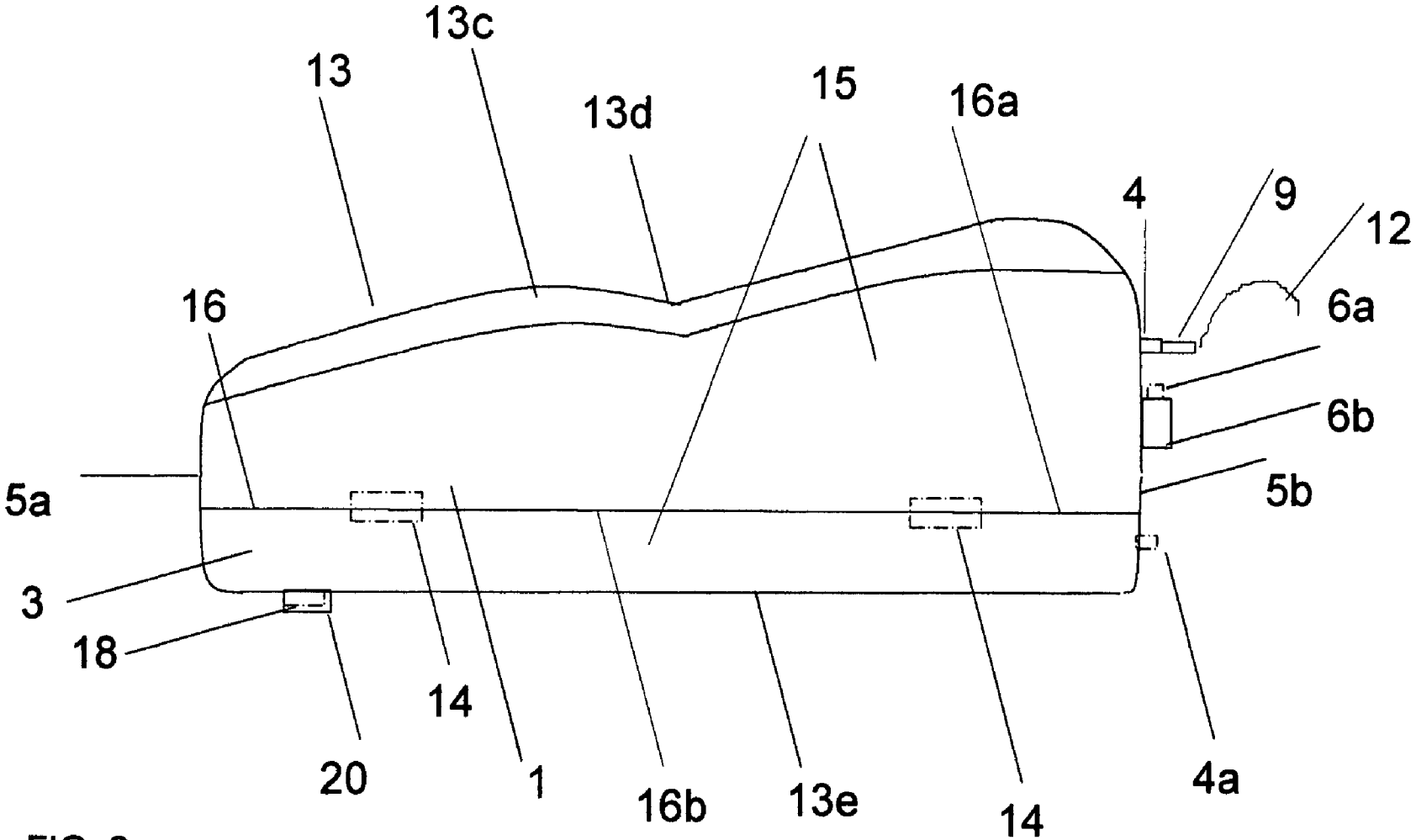
FIG. 2 is a side view of the invention of FIG. 1

In FIG. 1, the topmost surface 13 is composed of a single sheet of vinyl that is radio frequency (RF) welded to the lateral sides and front and back surfaces of the FE 2. The topmost surface 13, first end 5*a* and the second end 5*b* along with the lateral sides of the foot elevators were made of plain and flocked vinyl. The chambers 1 and 3 may share a common surface such as sheet 16 with its first and second surfaces 16*a* and 16*b* forming the bottom and top surfaces of chambers 1 and 3, respectively. Chambers 1 and 3 may also be fabricated with separate sheets similar to sheet 16 such that the only communication between the two chambers must be via valves 14. Typically valves 14 may have cracking pressures greater than or equal to 0.3 Psig. The valves may be relief valves or check values. The relief valves 14 are mounted such that fluid (e.g., air) 15 can only be transferred from chamber 1 to chamber 3 by way of the valves. The inflatable FE 2 is inflated by activating pump 6, which is connected to FE 2 by way of Schrader valve 4, detachable non-leak connector 9 (not shown in FIG. 1) and flexible tube 12. The Schrader valve 4 is shown mounted on the second end 5*b* of FE 2. However, it could be mounted on either of the two exposed lateral surfaces of the FE 2 shown in FIG. 1. Fluid 15 can also be pumped into the interior of FE 2 via a push-pull or relief valve instead of a Schrader valve. Schrader valve 4 is designed to prevent the back flow of pressurized air 15 from the FE 2. The control of the OFF/ON status of the pump 6 is accomplished through an ordinary switch in switch box 7, which is electrically attached to electrical pair 8*a*. The pump 6 may be powered by ordinary dc or ac sources activated by switch 7 shown in FIG. 1. Pouch 6*b*, (not shown in FIG. 1) which is shown in FIG. 2 is mounted on distal end 5*b* of FE 2, is designed to accept vibrator 6*a* with virtual mechanical interference. The vibrator 6*a* can also be controlled by an ordinary switch in switch box 7 which is connected to vibrator 6*a* by paired electrical lead 8*b*. The amplitude and frequency of operation of vibrator 6*a* is controlled by an ordinary frequency and voltage controller (not shown in the figures) included in switch box 7. The vibrational mode of operation of vibrator 6*a* in this invention is achieved by mounting an eccentric load on the shaft of a motor that is mounted in a hard plastic enclosure. It could be achieved by other methods such as translational movement of a load. In order to prevent sliding of FE 2 during use, Magnet buttons 18 are attached to the lower outer surface 13*e* of the bottom chamber 3 of the inflatable FE 2 by inserting one each in plastic pouches 20. Retaining magnet buttons 22 are placed beneath the surface of bed covering 24 or a covering on which the user may be reclining. The retaining magnets prevents foot elevator 2 from slipping from beneath the LBE during use. While the paired magnets may be used to anchor the foot elevator, the foot elevator may be used without this anchoring method or other stabilizing methods.

The source of air for pressurization of the inflatable FE 2 in the first embodiment is pump 6. It could, however, be a small container of pressurized air or other mechanical sources of pressurizing air. Fluid 15 can be evacuated from chambers 3 and chamber 1 via push-pull valve 4*a* and Schrader 4(see FIG. 2), respectively.

As stated previously, Schrader 4 may be a push-pull valve or furthermore it could be any inherently two way flow valve.

SECOND EMBODIMENT

Figure 3:
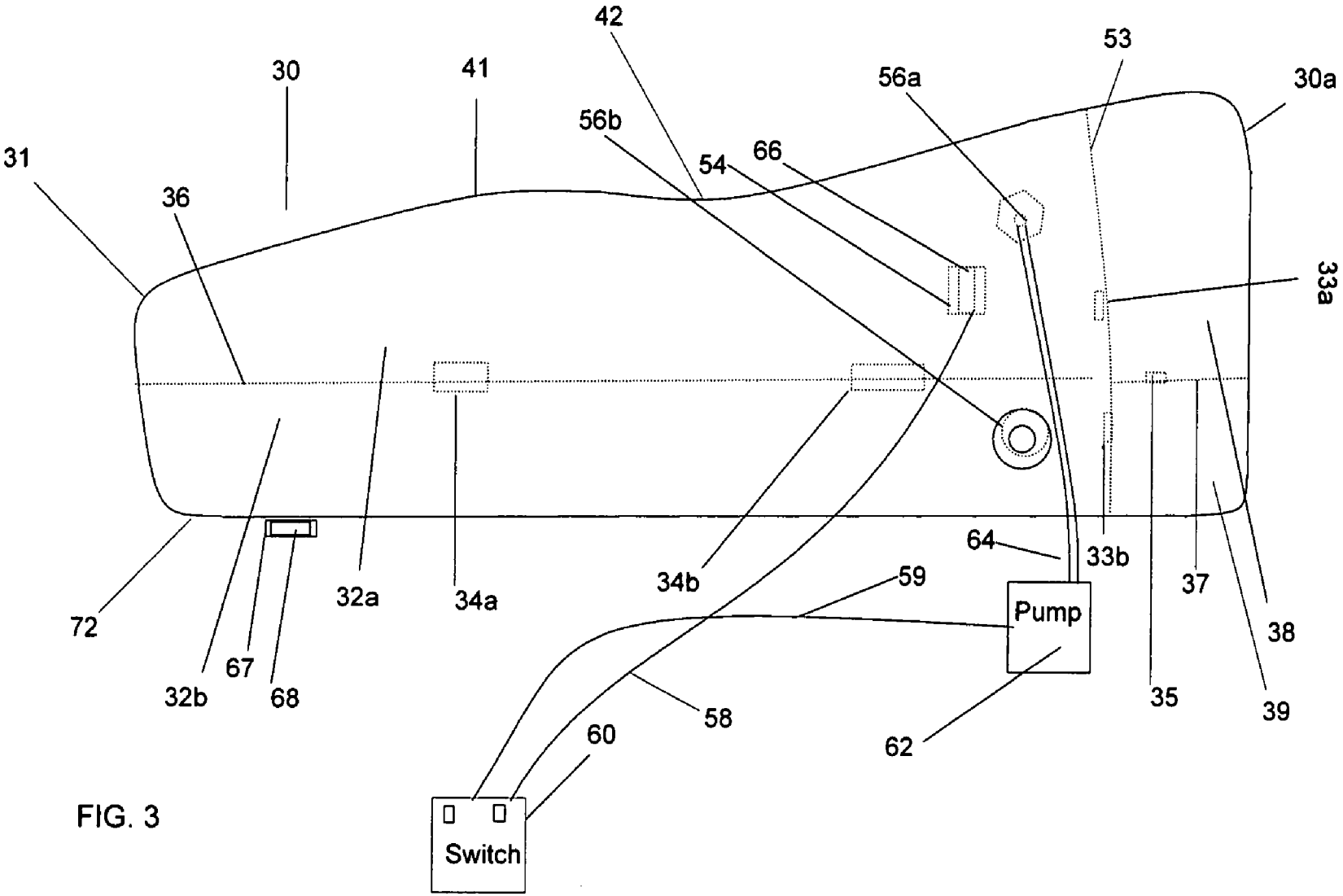
FIG. 3 is a prospective view of the second embodiment of the device of this invention.

FIG. 3 shows the second embodiment of the device of this invention. The inflatable foot elevator 30 of the second embodiment comprises chambers 32*a* and 32*b*, which are isolated/sealed from each other by relief valves 34*a* and 34*b*, sheet 36, and extension 30*a* which is functionally isolated from chambers 32*a* and 32*b* by vertical sheet 53 and relief valves 33*a* and 33*b* . The extension 30*a* is divided into chambers or cavities 38 and 39 by sheet 37. Fluid communication between these cavities is supported by relief valve 35 which provides for flow from 33*a* to 33*b* . Inflation and deflation air can be supplied to foot elevator or removed therefrom, respectively, by way of push-pull valves 56*a* and 56*b*. When the pressure in chamber 32*a* is less than the cracking pressure of relief valves 34*a* and 34*b*, only chamber 32*a* can be inflated. Relief valves 34*a* and 34*b* are designed to open only when the air pressure in the topmost chamber 32*a* reaches a prescribed pressure (i.e., the cracking pressure of relief valves 34*a* and *b*) at which time the relief valves 34*a* (FIG. 3 shows one of three relief valves aligned transversely on plastic sheet 36) and 34*b* (one of three valves aligned transversely on plastic sheet 36) are designed to open so that the second chamber 32*b* (i.e., bottom chamber) may be pressurized. When 32*a* and 32*b* are inflated the foot elevator is designed to accommodate a certain set of users. Lengthwise, the surface 31 contains one undulation with crest 41 and trough 42. While not shown in FIG. 3, widthwise the surface 31 may have one or more undulations. The trough 42 extends across the width of foot elevator 30 (hereafter referred to as FE 30).

The FE 30 has the inflatable extension 30*a* which contain chambers 39 and 38. The chambers 38 and 39 are separated from chambers 32*a* and 32*b* via vertical extending sheet 53. The chambers 38 and 39 when inflated enable the foot elevator to accommodate tall users. The chambers 38 and 39 are separated by sheet 37 which contains valve 35. The valve 35 may be a relief or check valve. The extension 30*a* is connected to chamber 32*a* via relief valve 33*a* which has a higher cracking pressure than relief valves 34*a* and 34*b*. Valves 33*a* and b are mounted in sheet 53 where they allow flow from chambers 32*a* to 38 and 32*b* to 39, respectively. The difference in cracking pressure is such that it is at least 10% higher than that of the relief valves 34*a* and *b*. The inflatable foot elevator 30 in FIG. 3 is shown, as it would be fully deployed. Push-pull valves 56*a* and 56*b* are mounted on one of the lateral sides of chambers 32*a* and 32*b*.

The vibrator 66 is electrically connected to switch 60 via the electrical lead 58. The vibrator is mounted in pouch 54 in a manner that it causes vibrational modes to enter the fluid and the exterior surface of the foot elevator 30. Also in FIG. 3, electrical leads 59 are connected to pump 62 which in turn are connected to push-pull valve 56*a* by tubing 64. The extension 30*a* makes it possible for the invention of the second embodiment to be used by people of different heights. The FE 30 has magnet button 67 mounted in pouch 68 which is attached to bottom 72 of chamber 32*b*.

THIRD EMBODIMENT

Figure 4:
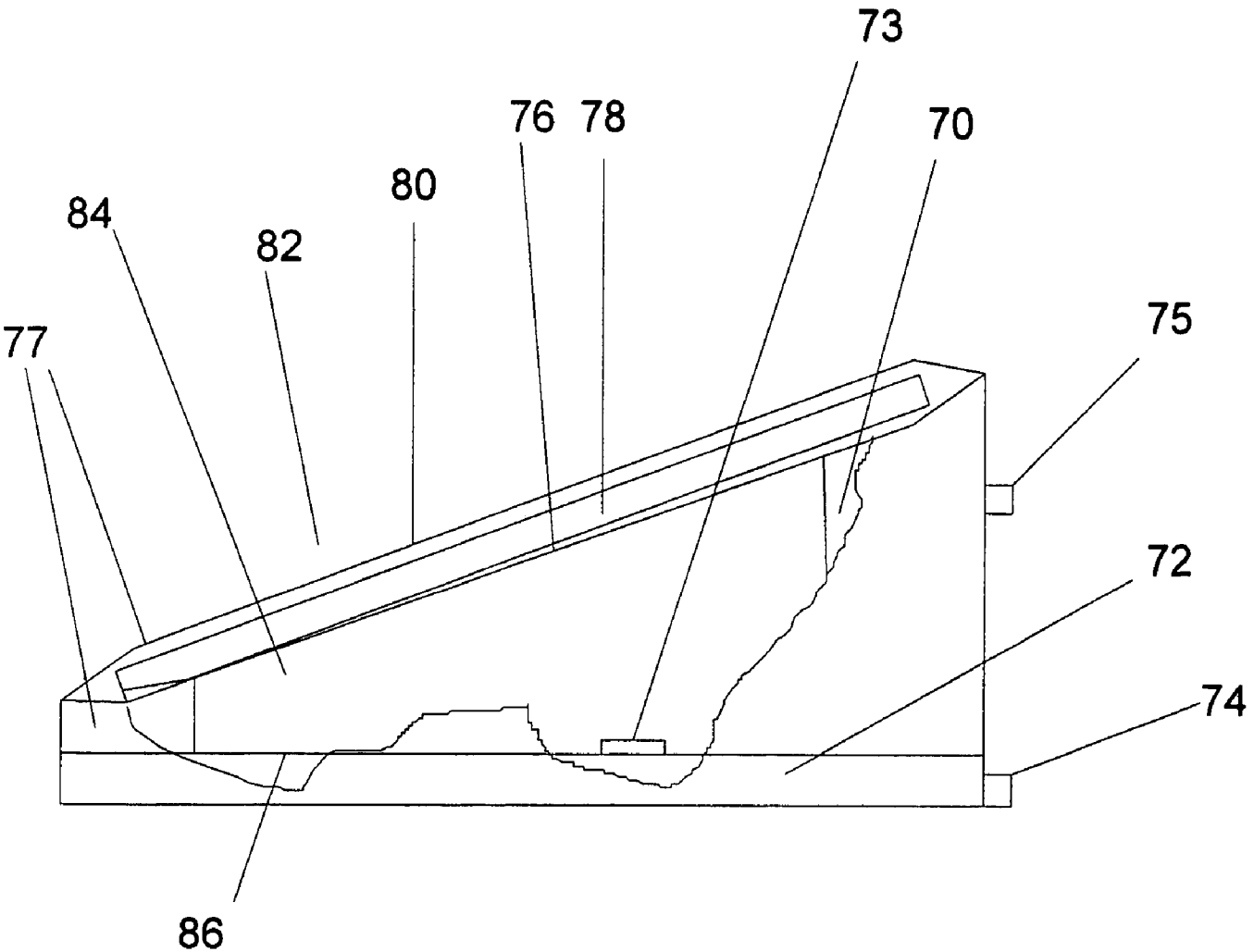
FIG. 4 is a sectional view of the third embodiment of the foot elevator of this invention.

FIG. 4 shows the third embodiment of the foot elevator. The foot elevator 82 has two horizontally disposed cavities 70 and 72 with vinyl exterior surfaces 77. All of the exterior surfaces can be made of vinyl or a combination of vinyl with flocked surfaces. Fluid communication between cavities 70 and 72 is controlled by relief valve 73 which is mounted in sheet 86. Inflation or deflation of cavities is accomplished via electrical pumps coupled to push-pull valves 74 and 75. The foot elevator 82 is inflated with an electric air pump. It could however be inflated with a mechanical air pump The topmost surface of the foot elevator in FIG. 4 is made using a laminate of vinyl sheet 80 memory foam 78 vinyl sheet 76, which when combined provide a surface that automatically conforms to the shape of the body parts resting thereupon. The laminate of FIG. 4 is a sandwich of vinyl-memory-vinyl. It could be formed with a single sheet of vinyl in contact with memory foam or other materials. The shape of the foot elevator 82 will be maintained by anti ballooning elements 84.

BEST MODE FOR OPERATING THE DEVICE OF THIS INVENTION

The operation of FE 2 of the first embodiment will now be explained. When the inflatable FE 2 is deployed on a bed, the retaining magnets 22 may be used to hold the FE 2 in its position by placing an intervening sheet or bed covering 24 between the magnet buttons 18 and the retaining magnets 22. The button magnets 18 and retaining magnets 22 may be made of ceramic magnets such as neodymium, cobalt or other high strength magnetic materials. When the bed covering or sheet is captured between the two pairs of magnets, they will provide non-slip positioning of the foot elevator of the first and second embodiments of this invention. When pump 6 is powered and mechanically coupled to tube 12 with its non-leak connector 9 which is in term connected to the Schrader valve 4, FE 2 can be inflated to a comfortable height by controlling the OFF or ON position of switch 7 Once the desired elevator height is achieved, the flexible hose is decoupled from the Schrader valve 4 where it is held by non-leak detachable connector 9 When fully deployed, FE 2 is designed to support the feet, the lower legs and the knees. The non-leak connector 9 contains a valve stem depressor for opening Schrader 4. The user may inflate only the chamber 1 or inflate both chambers 1 and 3 during use. Returning to the use of foot elevator retention magnets, the device has been shown to exhibit good stability when in use without the magnetic pairs separated by an intervening member for stability. Also, the Schrader valve may be replaced by an ordinary push-pull or relief valve.

The prismatoid FE 2 of the first and second embodiments of this invention is here described an inflatable apparatus having a rectangular shape with a vibrator mounted upon one of its lateral surfaces to provide vibratory input energy to the LBE of a user. The foot elevator could, however, have one of many different three-dimensional shapes. They also could have been made using a solid three-dimensional contoured polymeric material designed to receive and support the lower members of the human body at elevated positions relative to the upper portions of a person.

Two embodiments of the invention have been described. Nevertheless, it will be understood that various modifications may be made without departing from the spirit and scope of the invention. Accordingly, other embodiments are within the scope of the following claims.

We claim:

1. A foot elevator for elevating a region of a human body comprises:

at least two adjacent prismatoid cavities, each cavity comprises at least one horizontal chamber therein communicating with each other via a relief valve enabling the sequential inflation or deflation of one of the said at least two adjacent prismatoid cavities;

external surface mounted valve means coupled to an ordinary electrical air pump for inflating and deflating the at least two adjacent prismatoid cavities;

a shaped surface on one of the at least two adjacent prismatoid cavities for controlling the position of the members of the lower extremities of the body when situated thereupon, where the contour of said shaped surface is determined by anti-ballooning variable height vanes mounted within the interior of the at least two adjacent prismatoid cavities;

anchoring means attached to said foot elevator for preventing slippage of the elevator when it is in use; and, vibrator means for inputting a vibratory motion into the shaped surface of the foot elevator.

2. The foot elevator of claim 1 where the shaped surface has at least one undulation widthwise and a single undulation lengthwise formed by said anti-ballooning variable height vanes mounted within the interior of the at least two adjacent prismatoid cavities.

3. The foot elevator of claim 1 where the anchoring means comprises magnetic means.

4. The foot elevator of claim 1 where the vibrator means for inputting vibratory motion into the shaped surface comprises an electric motor with an eccentrically loaded output shaft or a translational moveable load coupled to the output shaft of said electric motor.

* * * * *